US005083250A

United States Patent [19]

Malcolm

[11] Patent Number: 5,083,250

[45] Date of Patent: Jan. 21, 1992

[54] FLOATABLE BALLON LIGHT ACCESSORY

[76] Inventor: Clarence D. Malcolm, 4925 O'Sullivan Dr., Los Angeles, Calif. 90032

[21] Appl. No.: 643,354

[22] Filed: Jan. 22, 1991

[51] Int. Cl.[5] ..... F21V 33/00

[52] U.S. Cl. ..... 362/253; 362/352; 362/202

[58] Field of Search ..... 362/96, 186, 352, 190, 362/191, 202

[56] References Cited

U.S. PATENT DOCUMENTS

| | | | |
|---|---|---|---|
| 1,530,923 | 3/1925 | Anns | 362/382 |
| 1,776,182 | 9/1930 | Cook | 362/278 |
| 2,099,167 | 11/1937 | Koepke | 362/190 |
| 3,536,906 | 10/1970 | Bloom | 362/806 |
| 3,592,157 | 7/1971 | Schwartz | 362/62 |
| 4,292,999 | 10/1981 | Szollmann | 362/96 |
| 4,542,445 | 9/1985 | Marletta | 362/96 |
| 4,736,281 | 4/1988 | Neumeier | 362/186 |
| 4,794,498 | 12/1988 | Neumeier | 362/186 |
| 4,997,403 | 3/1991 | Akman | 446/220 |

FOREIGN PATENT DOCUMENTS

| | | | |
|---|---|---|---|
| 1100165 | 2/1961 | Fed. Rep. of Germany | 362/186 |

*Primary Examiner*—Ira S. Lazarus
*Assistant Examiner*—Leonard Heyman
*Attorney, Agent, or Firm*—Robert M. Sperry

[57] ABSTRACT

Illuminating means for balloons comprising a light-weight plastic cone insertable into the orifice of the balloon so as to prevent escape of gas from within the balloon and to prevent damage to illuminating means located within said cone, an electric light means mounted within said cone, said cone and light bulb being light enough to be lifted by a conventional lighter-than-air gas-filled elastic balloon, and means for supplying electrical energy to said light means.

17 Claims, 5 Drawing Sheets

3B
3A
3
3D
3C
2B
2
5
6B
6C
6A
6

FLOATABLE BALLON LIGHT ACCESSORY

BACKGROUND

Related Documents

This invention is described in Disclosure Document No. 232254,

FIELD OF INVENTION

This invention relates to elastic balloons used as toys, decorations or advertising devices and is particularly directed to floatable accessory means for sealing and illuminating lighter-than-air gas-filled balloons.

PRIOR ART

Since the earliest development and merchandising of the toy balloon—made of an elastically expandible material, such as rubber, and characterized by an inflatable bulb and a tubular neck having an orifice affording its inflation—commercial vendors have sought better means for rapidly sealing balloons against gas leakage. Known in the art are various and numerous accessories that have been developed for this principal purpose; most of which either clasp or attach outside the neck, or insert into the orifice, of a balloon. The former type are most popular with vendors because they are simplest in design, lightest in weight, lowest in cost and are easy to use; while the latter type are rarely employed because they are more complicated in design, heavier in weight, higher in cost and most arduous to use. The former abound in the art, while the latter are far less common. Nevertheless, only accessories which insert inside the orifice of a balloon have the capacity to produce a combined function for inflating, sealing, tethering, illuminating and otherwise enhancing the appeal of a toy balloon. The present invention relates to these unusual insertable accessories and, more especially, to insertable accessories having an illuminative function for lighting a toy balloon.

A significant problem shared by vendors everywhere, second only to the fundamental problem of sealing the orifice of the balloon against gas leakage, is the need to illuminate balloons since even gas-filled balloons are most difficult to sell at night, because they are not clearly visible nor are their bright and various colors able to be distinguished in darkness. This problem represents a tremendous loss in sales and income to vendors due to the fact that most amusement parks, fairs, festivals, carnivals and other similar events and attractions are open till midnight or later. Nevertheless, in spite of this eminent need, investigative research, undergone prior to this disclosure, into major United States companies involved in the production, distribution and marketing of toy balloons and related products (including a review of their respective catalogs and sales literature), reveals that no device or accessory which functions to illuminate a buoyant balloon is available for public purchase. Moreover, it is evident that no such accessory is being merchandised at amusement parks, fairs, circuses and the like, nor can any illuminative accessory be found at costume and party supply stores, florist shops or wholesale or retail concerns that generally sell gas-filled toy balloons. This absence in availability of any illuminative accessory must be attributed to one of two causes; either a lack of supply due to no production or restricted production, or a lack of demand because vendors, for any number of reasons, do not find them practical or appealing for resale purposes with balloons.

An illuminative accessory is acceptable to vendors only when its design and application meet particular criteria relative to the nature of the gas-filled balloon enterprise. These are primarily as follows: one, the essential embodiment for an illuminative accessory must be such that it readily conforms to the typical inflation apparatus, handling and employment procedure already common to vendors in preparing gas-filled balloons for sale; second, it must be ultra-light in weight and capable of floating aloft so as not to noticeably reduce the buoyant balloon's "float time"; third, it must be small and portable so that it can be carried about by a child like an ordinary gas-filled balloon; fourth, ideally, its lamp must emit intense light so as to brightly illuminate the balloon for the length of time that it is buoyant without prematurely draining the attached power supply; fifth, the illuminative accessory should create a dramatic visual effect through the balloon so as to attract people's attention; and, sixth, it must be of minimal cost so as not to substantially increase the retail price of the gas-filled balloon.

Having established above, the criteria expected by vendors of an illuminative accessory, examples of prior art devices may be examined to determine conformity or deficiencies and, consequently, evidence claims for the present invention as a novel improvement over the prior art. A search in the United States Patent Office has revealed the following:

| U.S. PAT. NO. | INVENTOR | ISSUED |
|---|---|---|
| 4,292,999 | A. Szollmann | Oct. 6, 1981 |
| 4,737,133 | R. Neumeier | Apr. 12, 1988 |
| 4,542,445 | M. Marletta | Sep. 17, 1985 |
| 2,646,019 | C. H. Chetlan | Jul. 21, 1953 |
| 3,721,983 | O. Sherer | Mar. 20, 1973 |
| 1,530,923 | H. F. Anns | Mar. 24, 1925 |
| 1,229,794 | A. Salzer | Jun. 12, 1917 |
| 1,776,182 | H. A. Cook | Sep. 16, 1930 |
| 2,395,006 | A. Y. Leslie | Feb. 19, 1946 |
| 1,820,681 | J. Schmalbach | Aug. 25, 1931 |
| 4,167,204 | A. Zeyra | Sep. 11, 1979 |
| 4,142,322 | A. Zeyra | Mar. 6, 1979 |
| 4,687,458 | K. Handa | Aug. 18, 1987 |
| 3,094,807 | I. Dorman | Jun. 25, 1963 |
| 2,396,906 | A. E. Windson | Mar. 19, 1946 |
| 4,701,148 | J. Cotey | Oct. 20, 1987 |
| 1,467,411 | A. P. Witten | Sep. 11, 1923 |
| 4,881,916 | D. Houser | Nov. 21, 1989 |
| 4,799,914 | J. Hutchinson | Jan. 24, 1989 |
| 4,380,103 | J. McGrath | Apr. 19, 1983 |
| | FOREIGN PATENTS | |
| PATENT NO. | COUNTRY | ISSUED |
| 7,917,457 | France | Feb. 1981 |
| 1,414,922 | France | Sep. 1965 |
| 1,016,073 | France | Aug. 1952 |
| 3,015,962 | Fed. Rep. of Germany | Nov. 1981 |
| 2,854,093 | Fed. Rep. of Germany | May 1980 |
| 8,401,306 | Great Britain | Apr. 1984 |
| 2,027,351 | Great Britain | Feb. 1980 |

Accessories for toy balloons, including an illuminative function, are disclosed in the patents to Szollmann, Marletta and Neumeier. However, although each of these accessories provide illumination for a balloon, all are entirely unsuitable for use by typical vendors because none of them disclose an essential embodiment wherein a portable power supply conjoins an illuminative assembly that is floatable, or capable of free buoyancy, once inserted inside the orifice of a gas-filled toy balloon. Failure to combine these necessary attributes represents a major deficiency. Vendors will not accept an illuminative device unless it enables a gas-filled balloon to float aloft and be carried about tethered by a length of cord, in the manner common to ordinary gas-filled balloons.

Another deficiency shared by the illuminative accessories of the prior art, is that each one incorporates a built-in inflation valve that enables it to inflate a collapsed balloon, once it is fitted inside the balloon's orifice. Vendors will not employ any illuminative accessory comprising an inflation device because they recognize it to be an inept feature. They are not concerned about means for inflating balloons since they already possess conventional apparatus for this purpose. Moreover, their orthodox procedure in using this apparatus entails the application of an accessory only after the balloon is first inflated with a lighter-than-air gas, and not before. Finally, another drawback of the prior art devices is that the "float time" of a gas-filled balloon is reduced by the greater weight of an illuminative accessory incorporating an inflation valve.

BRIEF SUMMARY AND OBJECTS OF INVENTION

These disadvantages of prior art illuminative devices for elastic balloons are overcome with the present invention and means are provided for sealing and illuminating lighter-than-air gas-filled elastic balloons to permit outdoor night-time use of such balloons and to provide continued enjoyment of such balloons in dark environments where they have not previously been useful and to provide additional functions for such balloons which have not been possible with the illuminative devices of the prior art.

The advantages of the present invention are preferably attained by providing illuminating means for balloons comprising a lightweight plastic cone insertable into the orifice of the balloon so as to prevent escape of gas from within the balloon and to prevent damage to illuminating means located within said cone, an electric light means mounted within said cone, said cone and light means being lightweight enough to be lifted aloft by a conventional lighter-than-air gas-filled elastic balloon, and means for supplying electrical energy to said light means.

Accordingly, it is an object of the present invention to provide improved elastic balloons.

Another object of the present invention is to provide means for illuminating elastic balloons.

A further object of the present invention is to provide improved means for sealing elastic toy balloons.

An additional object of the present invention is to provide sealing and illuminating means for elastic toy balloons which are lightweight enough to be lifted aloft when the balloon is filled with lighter-than-air gas.

A further object of the present invention is to provide means for enabling the use of elastic balloons in dark environments.

An additional object of the present invention is to provide improved sealing and illuminating means for gas-filled balloons which readily conform to conventional inflation apparatus and to handling and employment procedures already common to vendors in preparing such balloons for sale.

Another object of the present invention is to provide improved sealing and illuminative means for lighter-than-air gas-filled balloons which is capable of floating aloft without noticeably reducing the balloons float time.

A specific object of the present invention is to provide sealing and illuminating means for balloons comprising a lightweight plastic cone insertable into the orifice of the balloon so as to prevent escape of gas from within the balloon and to prevent damage to illuminating means located within said cone, an electric light means mounted within said cone, said cone and light means being lightweight enough to be lifted aloft by a conventional lighter-than-air gas-filled elastic toy balloon, and means for supplying electrical energy to said light means.

These and other objects and features of the present invention will be apparent from the following detailed description, taken with reference to the figures of the accompanying drawing.

DETAILED DESCRIPTION OF THE INVENTION

Figure 1:
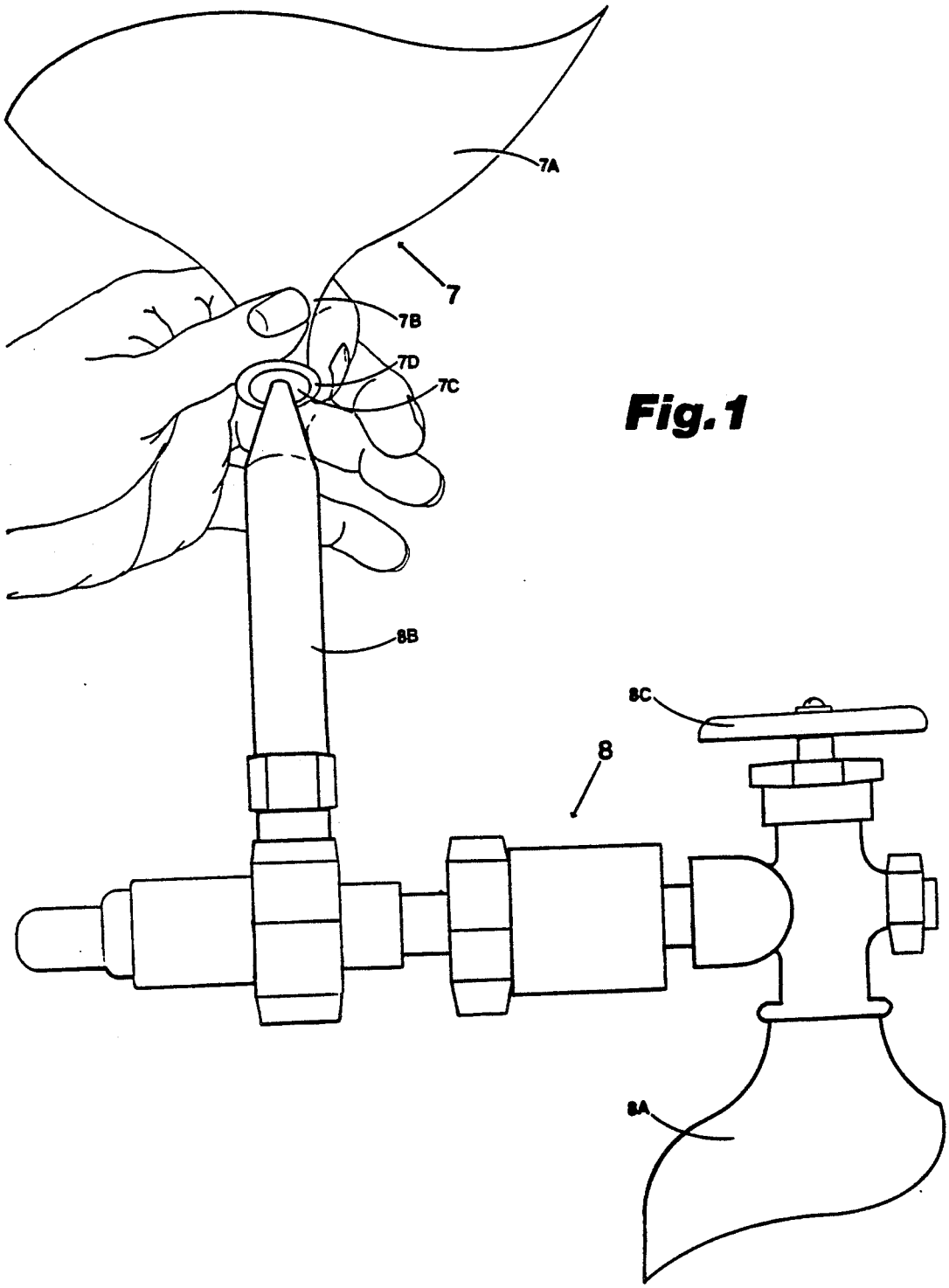
FIG. 1 is a diagrammatic representation showing the most common inflation apparatus and the method used by vendors for inflating a toy balloon with lighter-than-air gas.

Referring now to the drawing, and FIG. 1 in particular, the reference character 7 generally indicates a typical elastic toy balloon (shown fragmentary) having a bulb 7A, a tubular neck 7B and an orifice 7C encompassed by an annular bead 7D; while reference character 8 generally indicates a fragmentary rendition of the conventional inflation apparatus already used by most vendors for inflating a toy balloon 7 with a lighter-than-air gas, such as helium. This lighter-than-air gas is compressed in a suitable storage tank 8A and is released through a rubber injection nozzle 8B by rotating a primary control valve 8C. The usual dexterity typical of vendors for inflating a toy balloon 7 begins with a collapsed toy balloon 7 being held so that the vendor's thumb and index finger are pressed together over the tubular neck portion 7B, in order to slide the tubular neck portion 7B down over the conical vertex of the injection nozzle 8B. The balloon 7 is held in this fashion until it (7) is fully inflated (A standard toy balloon will have a diameter of approximately 9-16 inches when fully inflated). Then, the balloon 7 is removed in similar manner as it (7) was engaged so that the vendor's thumb and index finger continue to clasp the tubular neck portion 7B, to prevent any escape of the gas, as the tubular neck portion 7B is slid upward and off of the injection nozzle 8B. The vendor continues to hold the balloon 7 in this way until a chosen accessory is applied to seal closed the orifice 7C of the balloon 7 by use of the vendor's free hand.

Figure 2:
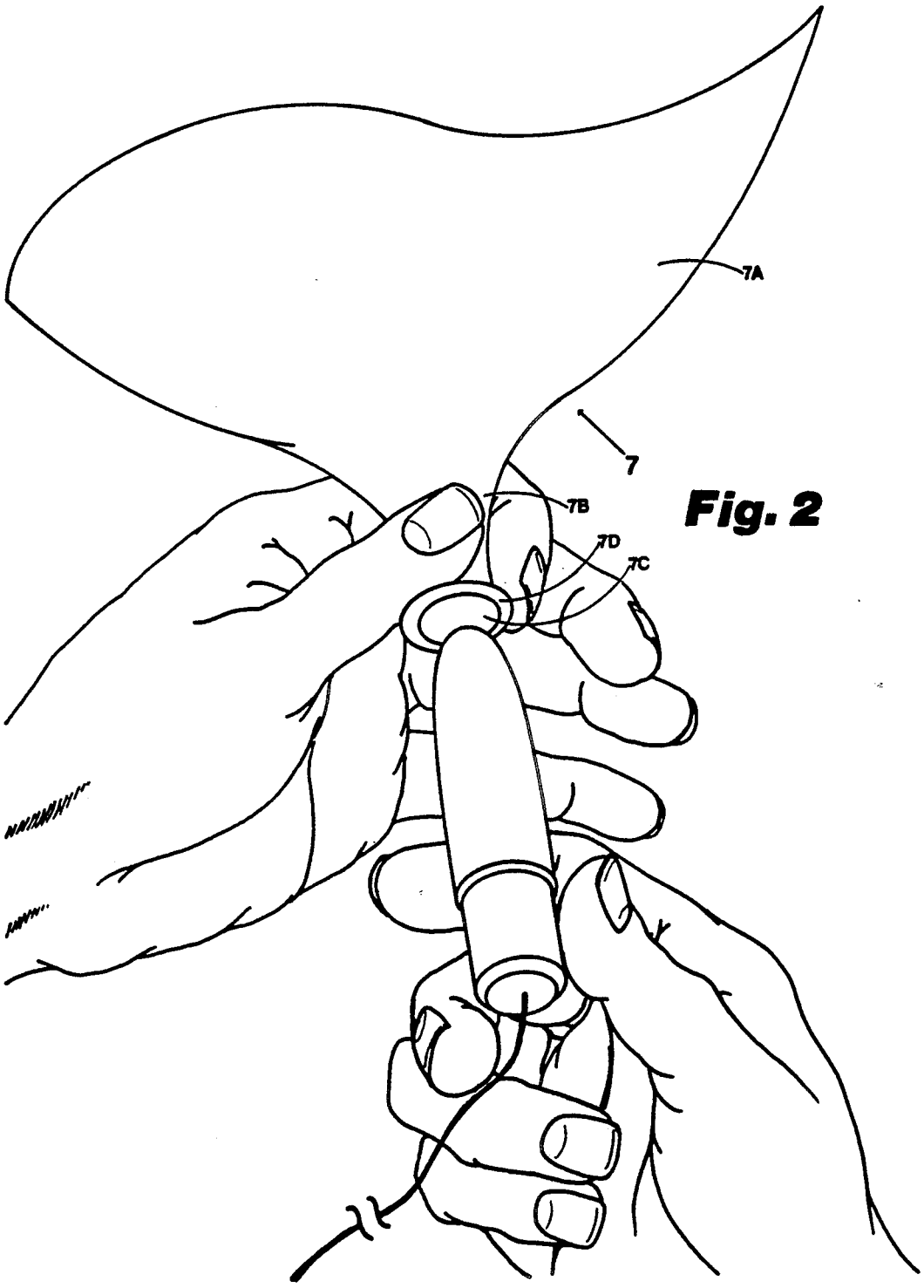
FIG. 2 is a diagrammatic representation, similar to that of FIG. 1, showing the sealing and illuminating device of the present invention being inserted into a balloon.

Referring next to FIGS. 1 and 2 of the drawings, and FIG. 2 in particular, which illustrate the application of the floatable balloon light accessory of the present invention (showing how its method of use is analogous to the typical inflation apparatus and handling and employment procedure already commonly used by vendors, as described previously in reference to FIG. 1), where, in accordance, the vendor, while still clasping the tubular neck portion 7B of the gas-filled balloon 7 between his thumb and index finger, uses his free hand to grasp the floatable balloon light accessory (by using the thumb and index finger of his free hand) in order to slide the tubular neck portion 7B down over the ideally-shaped floatable balloon light accessory by way of the orifice 7C of the balloon 7, thus distending the tubular neck portion 7B around the periphery of the floatable balloon light accessory, resulting in an air-tight frictional adherence between the elastic tubular neck portion 7C and the rigid floatable illuminative accessory. The gas-filled elastic toy balloon is now effectively sealed against leakage and, simultaneously, fitted for illumination.

Figure 3:
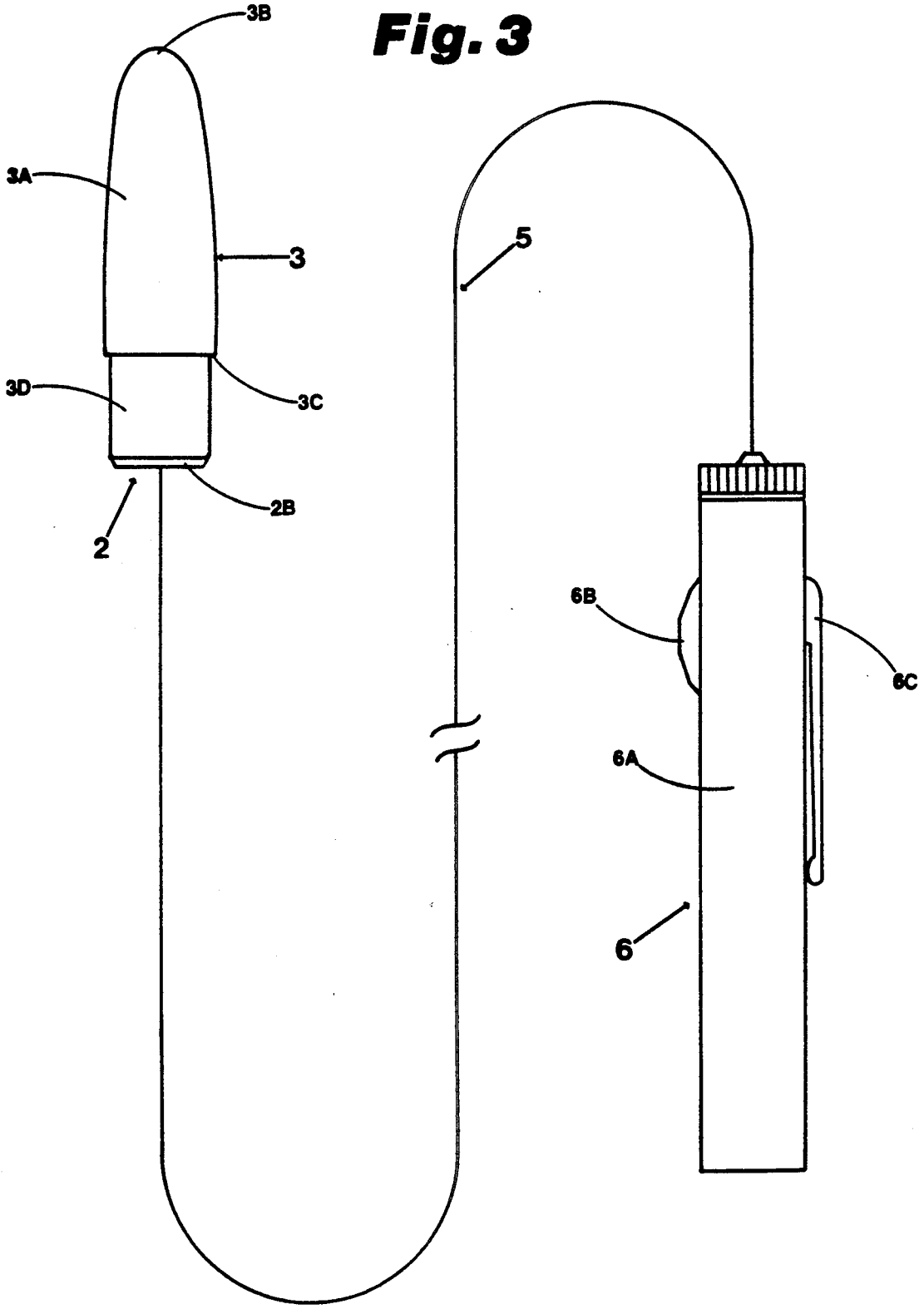
FIG. 3 is a side view of the sealing and illuminating device of the present invention.
Figure 4:
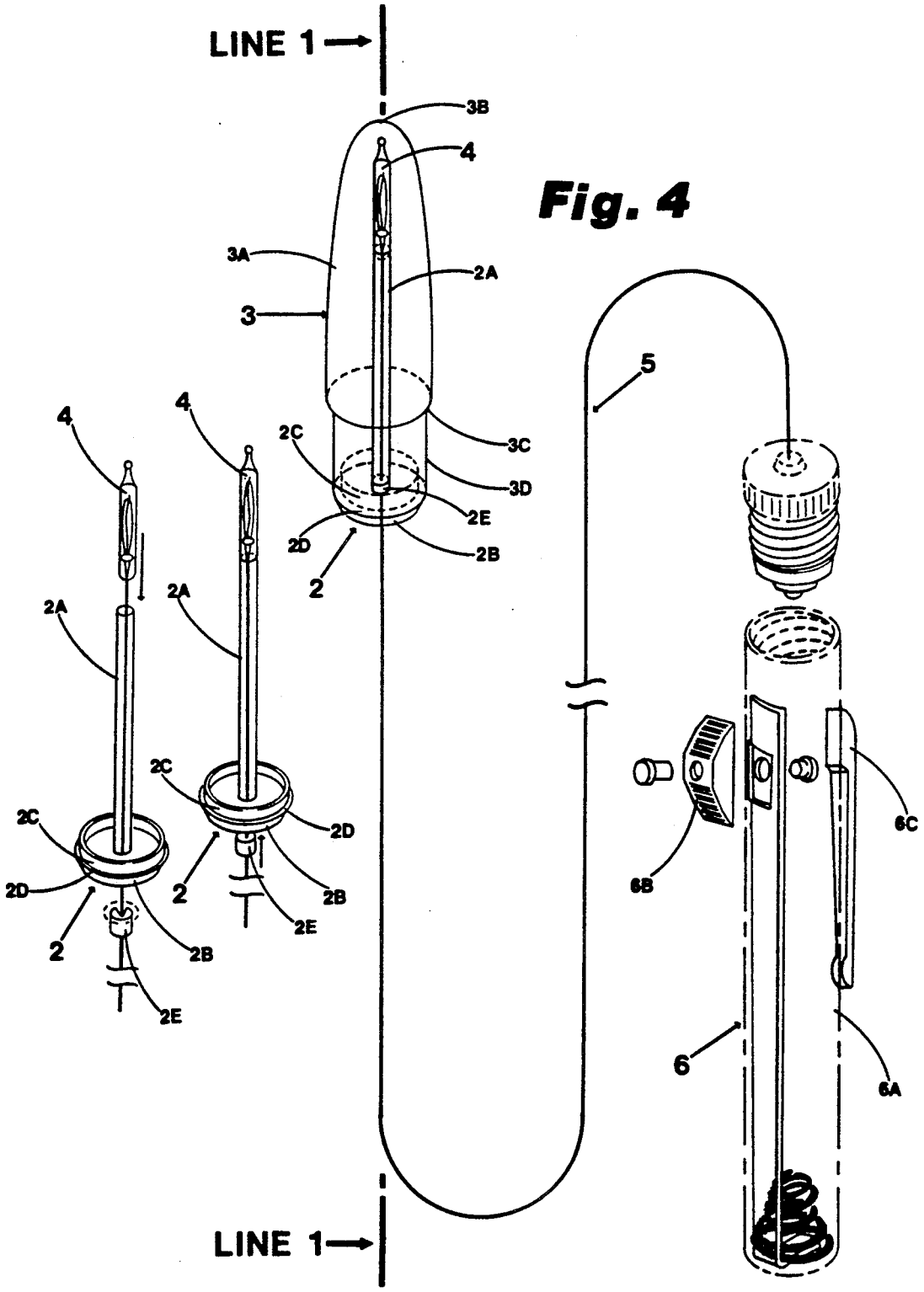
FIG. 4 is an exploded view of the sealing and illuminating device of FIG. 3.
Figure 5:
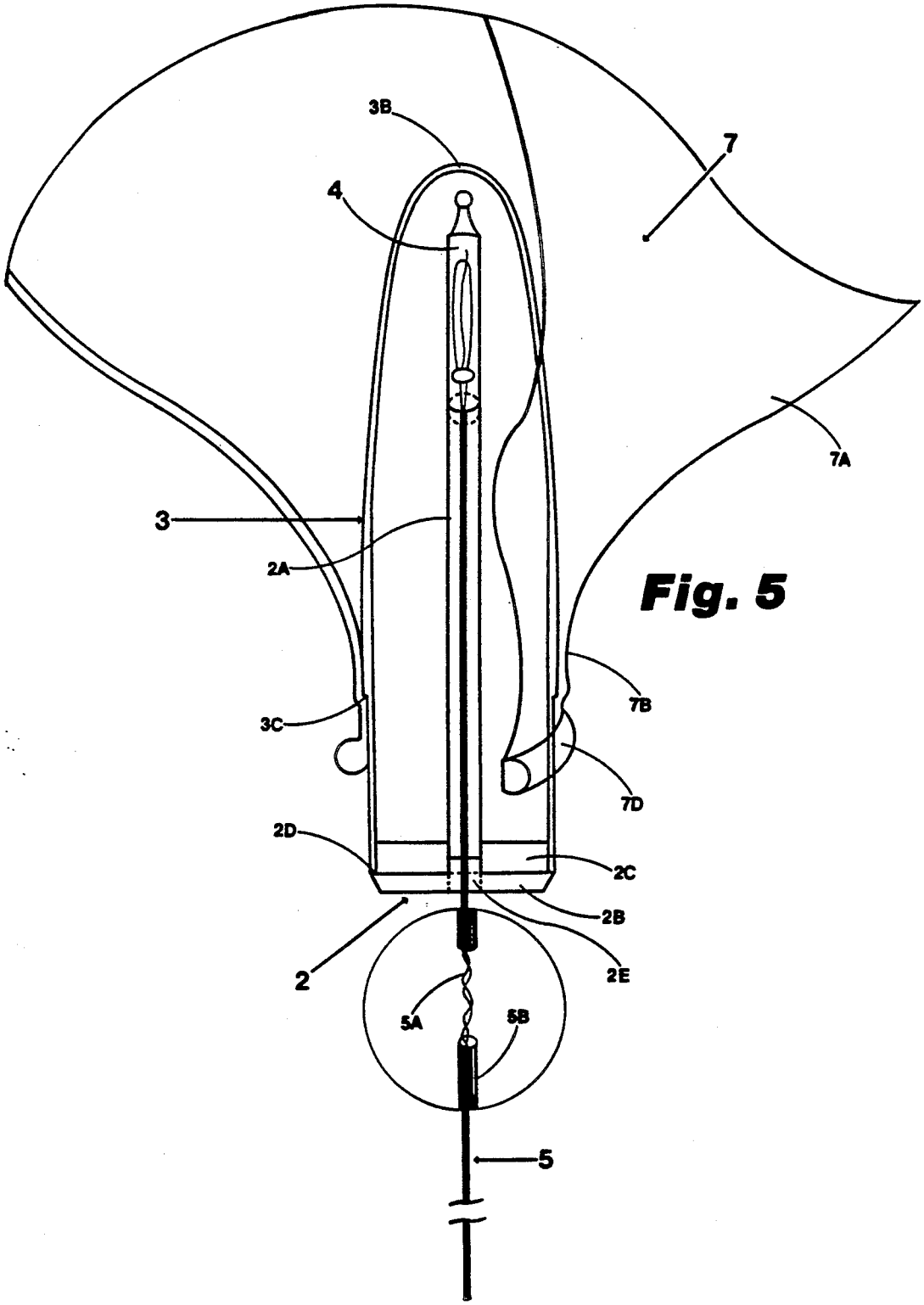
FIG. 5 is an enlarged sectional view, taken on the line 1—1 of FIG. 4.

Referring now to FIGS. 3, 4 and 5, and in particular to FIG. 4, the floatable balloon light accessory is shown, according to the preferred embodiment, comprising an incandescent flasher lamp 4 (such as is available, under the designation "toy flasher lamp" having a length of about ¾ inch and a diameter of about 3/16 inch from San Guang Electronics Company, Ltd. of Hsin Chu, Taiwan) which is remotely activated, through a relatively long length of flexible electrically conductive cord 5, by a thumb-operated "ON/OFF" control switch 6B mounted on a portable, hand-held power supply 6, having a plastic cylindrical housing 6A for containing batteries. Positioned opposite the switch 6B toward the upper end of the cylindrical power supply 6 is a pocket clip 6C which provides for convenient handling of the floatable balloon light accessory. Sliding the switch 6B upward closes the circuit, while sliding the switch 6B downward opens the circuit. The conductive cord 5 combines dual monofiliments of 34 quage insulated copper cable cord 5A (such as is available, under the designation "wire cable cord", from Consolidated Electronic Wire and Cable Corporation of Franklin Park, Ill., U.S.A.) bonded together by an outer rubbery coating 5B (See FIG. 5). This electrically conductive cord 5 is distinguished by its exceptional strength, flexibility, relatively thin diameter and the ultra-light weight which, together, make it the ideal conductor for electrical current between the power supply 6 and the incandescent flasher lamp 4.

The portable, hand-held power supply 6 is the only part of the floatable balloon light accessory which is not actually floatable because the power supply 6 is too heavy to be lifted by the lighter-than-air gas-filled balloon 7. The weight of the power supply 6 serves as an anchor in tethering the buoyant balloon 7 and floatable balloon light accessory.

While the incandescent flasher lamp 4 is illustrated to be the preferred illuminative means, a standard, non-flashing, incandescent lamp may be substituted in place of the incandescent flasher lamp 4. This standard incandescent lamp is the type which is used exclusively for the illuminative accessories disclosed in the prior art. However, the standard incandescent lamp is disadvantageous because is draws excessive current and, thus, drains the batteries of the power supply far too quickly. Vendors prefer that the gas-filled balloon 7 remain illuminated for the longest possible time, while the balloon 7 remains buoyant. Only the incandescent flasher lamp 4 fulfills this interest for longevity because it functions to emit intermittent flashes of light so that the battery power is conserved over a longer period of time. Another benefit brought about by the incandescent flasher lamp 4 is that it produces intense light and dramatic visual effects throughout the gas-filled balloon 7, creating the illusion that the balloon is continuously appearing and disappearing.

The incandescent flasher lamp 4 is affixed atop a support fixture, generally indicated by the reference character 2, having a hollow, longitudinal, cylindrical shaft 2A which engages the incandescent flasher lamp 4 at the upper end of the shaft 2A. The length of the cylindrical shaft 2A is relatively long and its diameter is less than the diameter of the incandescent flasher lamp 4. Preferably, the flasher lamp 4 has a length of about ¾ of an inch and a diameter of about 3/16 of an inch, while the shaft 2A has a length of approximately 3 inches and a diameter of approximately ⅛ inch. The lower end of the shaft 2A integrally joins the bored center of a radially-extending flange 2B, which is positioned perpendicularly to the cylindrical shaft 2A and which constitutes the base of the support fixture 2. The diameter of the bored center of the base flange 2B is preferably proportionate to that of the shaft 2A, while the base flange 2B has a diameter of approximately ⅝ inch. The flange 2B includes a relatively short upwardly-extending annular lip 2C, which is longitudinally and axially aligned with the central shaft 2A. The annular lip 2C forms an integral shoulder 2D, which is slightly inset along the periphery of the flange 2B. One end of the length of electrically conductive cord 5 fuses to the incandescent flasher lamp 4, while the opposite end extends down through the inside of the cylindrical shaft 2A of the support fixture 2 and exits the lower end of the shaft 2A through the centrally bored flange 2B where the cord 5 is clasped and surrounded by a tubular-shaped rubber insert 2E, facilitated by a longitudinal slit halfway cut through the diameter of the rubber insert 2E, which slides into and fastens inside the centrally bored flange 2B and the lower end of the hollow shaft 2A so that the cord 5 is secured to the support fixture 2.

The support fixture 2 is enclosed by a conical housing 3, having a substantially conical dome portion 3A at its upper end which is distinguished by a semi-elliptic vertex 3B. The hollow dome portion 3A diametrically expands gradually downward from the semi-elliptic vertex 3B and forms a slightly inwardly-extending ninety degree annular rim 3C along the outer periphery where the dome 3A integrally joins a hollow tubular portion 3D having a circular opening at its bottom end. Therefore, the diameter of the tubular portion 3D is only slightly smaller than the diameter of the dome portion 3A along its circumference where the annular rim 3C is formed. The support fixture 2 unites with the conical housing 3 in such a way that the bottom end of the hollow tubular portion 3D of the conical housing 3 engagingly abuts the shoulder formation 2D of the support fixture 2 so that the interior surface at the lower end of the tubular portion 3D of the conical housing 3 axially contacts the exterior surface of the annular lip 2C of the support fixture 2. The upper end of the cylindrical shaft 2A supporting the incandescent flasher lamp 4 is centered longitudinally and positioned near the interior upper end of the dome portion 3A.

The novel shape of the conical housing 3 enables the floatable balloon light accessory to be quickly and easily inserted through the orifice 7C and inside the neck portion 7B of a lighter-than-air gas-filled elastic toy balloon 7. The annular bead 7D and neck portion 7B of the resilient balloon 7 is gradually distended as they are slid down over the semi-elliptic vertex 3B and dome portion 3A, across the annular rim 3C and onto the tubular dome portion 3D of the conical housing 3. The inner surface of the resilient skin of the balloon 7 encompasses and frictionally adheres to the outer periphery of the rigid conical housing 3 so as to create a sealing-tight association between the conical housing 3 and the distended bead 7D and neck portion 7B of the balloon 7. The annular rim 3C of the conical housing 3 serves to further secure the tubular neck 7B of the balloon 7 to the conical housing 3 and to prevent the neck 7B from separating by deforming the neck 7B inwardly ninety degrees where the neck 7B encompasses the tubular portion 3D.

The translucent quality and ultra-light weight of the support fixture 2 and conical housing 3 represent essential features for the floatable balloon light accessory which are attributed to a low density plastic polymer, such as polyphyenylene oxide, from which the support fixture 2 and conical housing 3 are preferably molded to a relatively thin gauge. The translucent material of the support fixture 2 and conical housing 3 diffuses the intense light emitted by the incandescent flasher lamp 4 and the ultra-light weight of the combined assembly of the incandescent flasher lamp 4, the flexible electrically-conductive cord 5, the support fixture 2 and the conical housing 3 permit the use of the floatable balloon light accessory with even a smaller size lighter-than-air gas-filled toy balloon, such as those having inflated diameters of about 6–8 inches, without noticeably impairing the buoyancy of the balloon 7.

The cylindrical shaft 2A of the support fixture 2 and the dome portion 3A of the conical housing 3 project the incandescent flasher lamp 4 upward beyond the tubular neck 7B and into the flaring bulb 7D of the lighter-than-air gas-filled toy balloon 7 so as to thoroughly illuminate the entire balloon 7.

It is believed understood that the invention is not necessarily confined to the specific use or uses thereof described above, since it may be utilized for any purpose to which it may be suited. Nor is the invention to be necessarily limited to the particular embodiments and construction, as illustrated and described, to carry out said principles; and there is no intention, in the use of such illustrations and descriptions, of excluding any equivalents of features shown and expounded or portions thereof; but it will be obvious to those skilled in the art that the invention may comprehend minor changes and modifications within the scope of the appended claims.

What is claimed is:

1. A floatable balloon light accessory comprising:
a light-weight plastic housing insertable into the orifice of a balloon to prevent escape of gas from within said balloon,
electric light means mounted within said housing, and
means for supplying electrical energy to said light means comprising a hollow cylindrical housing having a control switch mounted thereon,
at least one battery located within said cylindrical housing, and
an electrical cable connecting said control switch to said light means.

2. The balloon accessory of claim 1 wherein:
said housing comprises:
a generally conical hollow dome,
a shaft supporting said light means within said dome, and
a base flange extending substantially perpendicular to said shaft and supporting said shaft and said dome.

3. The balloon accessory of claim 1 wherein:
the diameter of said housing is sufficient to effectively prevent leakage of gas out of said balloon when said housing is inserted into said orifice of said balloon.

4. The balloon accessory of claim 1 wherein:
said light means is a toy flasher lamp having a length of about ¾ inch and a diameter of about 3/16 inch.

5. The balloon accessory of claim 1 wherein:
said electrical cable is dual monofilaments of 34 guage wire cable cord.

6. A floatable balloon light accessory comprising:
a light-weight plastic housing having a generally conical hollow dome insertable into the orifice of a balloon to prevent escape of gas from within said balloon,
electric light means mounted within said housing,
a shaft supporting said light means within said dome,
a base flange extending substantially perpendicular to said shaft and supporting said shaft within said dome, and
means for supplying electrical energy to said light means.

7. The balloon accessory of claim 6 wherein:
the weight of said housing and said light means is less than the lift provided when said balloon is inflated with lighter-than-air gas.

8. The balloon accessory of claim 6 wherein:
the diameter of said housing is sufficient to effectively prevent leakage of gas out of said balloon when said housing is inserted into said orifice of said balloon.

9. The balloon accessory of claim 6 wherein:
said light means is a toy flasher lamp having a length of about ¾ inch and a diameter of about 3/16 inch.

10. The balloon accessory of claim 6 wherein:
said means for supplying electrical energy to said light means comprises:
a hollow cylindrical housing having a control switch mounted thereon,
at least one battery located within said cylindrical housing, and
an electrical cable connecting said control switch to said light means.

11. The balloon accessory of claim 10 wherein:
said electrical cable is dual monofilaments of 34 guage wire cable cord.

12. A floatable balloon light accessory comprising:
a light-weight plastic housing insertable into the orifice of a balloon to prevent escape of gas from within said balloon;
electric light means mounted within said housing; and
means for supplying electrical energy to said light means comprising:
a hollow cylindrical housing having a control switch mounted thereon,
at least one battery located within said cylindrical housing, and
an electrical cable connecting said control switch to said light means.

13. The balloon accessory of claim 12 wherein:
said electrical cable is dual monofilaments of 34 guage wire cable cord.

14. The balloon accessory of claim 12 wherein:

the weight of said housing and said light means is less than the lift provided when said balloon is inflated with lighter-than-air gas.

15. The balloon accessory of claim 12 wherein:

said housing comprises:

a generally conical hollow dome, a shaft supporting said light means within said dome, and a base flange extending substantially perpendicular to said shaft and supporting said shaft and said dome.

16. The balloon accessory of claim 12 wherein:

the diameter of said housing is sufficient to effectively prevent leakage of gas out of said balloon when said housing is inserted into said orifice of said balloon.

17. The balloon accessory of claim 12 wherein:

said light means is a toy flasher lamp having a length of about ¾ inch and a diameter of about 3/16 inch.

* * * * *